US006966718B2

(12) United States Patent
Furukawa et al.

(10) Patent No.: US 6,966,718 B2
(45) Date of Patent: Nov. 22, 2005

(54) WRITING INSTRUMENT, WRITING INSTRUMENT CAP AND METHOD OF ASSEMBLY OF A WRITING INSTRUMENT CAP

(75) Inventors: Kazuhiko Furukawa, Kanagawa (JP); Yojiro Sano, Tokyo (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/250,335

(22) PCT Filed: Jan. 10, 2002

(86) PCT No.: PCT/JP02/00087

§ 371 (c)(1),
(2), (4) Date: Jul. 3, 2003

(87) PCT Pub. No.: WO02/055318

PCT Pub. Date: Jul. 18, 2002

(65) Prior Publication Data

US 2004/0052571 A1 Mar. 18, 2004

(30) Foreign Application Priority Data

Jan. 10, 2001 (JP) ..... 2001-002007
Jan. 10, 2001 (JP) ..... 2001-002008
Jan. 10, 2001 (JP) ..... 2001-002011

(51) Int. Cl.[7] ..... B43K 23/12

(52) U.S. Cl. ..... 401/247; 401/246; 401/243

(58) Field of Search ..... 401/202, 243, 401/245, 246, 247

(56) References Cited

U.S. PATENT DOCUMENTS 680,117 A * 8/1901 Boman ..... 401/243
4,844,642 A * 7/1989 Inaba et al. ..... 401/213
5,441,356 A * 8/1995 Cho ..... 401/247
5,915,871 A * 6/1999 Kobayashi et al. ..... 401/213

FOREIGN PATENT DOCUMENTS

JP 51-13961 Y2 4/1976
JP 57-59354 Y2 12/1982
JP 57-193587 12/1982
JP 61-12131 Y2 4/1986
JP 2513395 Y2 7/1996
JP 2000-218984 A 8/2000
JP 2000-272287 A 10/2000

* cited by examiner

*Primary Examiner*—David J. Walczak
(74) *Attorney, Agent, or Firm*—Buchanan Ingersoll PC

(57) ABSTRACT

A writing instrument includes a front barrel and an ink tank. When, with a rear barrel for accommodating the ink tank removably fitted on the ink tank, a cap formed to cover the front barrel is fitted on the front barrel, the cap is positioned and fastened by abutment of the opening end of the cap. The cap has a hollow for accommodating a point assembly. The inside diameter of the hollow exceeds the outside diameter of the front barrel and the outside diameter of a rear end of the rear barrel. A barrel hold is formed along the circumference on the inner wall portion of the cap, so that the barrel hold grips the outer periphery of the rear end of the rear barrel. A guide portion is formed on the inner wall portion of the cap, closer to the front side than the barrel hold, to restrain over insertion of the rear end of the rear barrel into the cap. A writing instrument cap is assembled of a cap body and a clip by engaging an engaging portion formed on the cap body and a hooking portion formed in the clip, and is constructed so that engagement becomes gradually tight as the clip is slid along the axis from a tacking position.

13 Claims, 11 Drawing Sheets

(a)

(b)

WRITING INSTRUMENT, WRITING INSTRUMENT CAP AND METHOD OF ASSEMBLY OF A WRITING INSTRUMENT CAP

TECHNICAL FIELD

The present invention relates to a writing instrument such as a ball-point pen, fountain pen and the like, a writing instrument cap and a method of assembly of a writing instrument cap.

BACKGROUND ART

Generally, for writing instruments such as oil-based ball-point pens, water-based ball-point pens, a removable cap for protecting the front end of the writing part by enclosing it when unused is provided.

Particularly, in some kinds of writing instruments, in order to prevent ink at the writing part from drying, the tip part is hermetically enclosed by the cap so that the part can be isolated from the outside air.

(Background Art 1)

As one of the conventionally known writing instrument configurations, a refill (replacement pen element) which is formed of a point assembly and an ink tank by engaging one with the other, is accommodated, on its tip side, into a front barrel, and on its ink tank side, into a rear barrel, forming an joined writing instrument structure of the front and rear barrels with the writing tip projected from the front barrel.

There is also another known configuration in which a front barrel is joined with a point assembly to bean integrated structure while a cartridge type ink tank (refill) is provided in the rear side of the front barrel, thereby forming a writing instrument body by screw engagement of the rear barrel with the front barrel.

However, with the former writing instrument body configuration, looseness at the connection between the front and rear barrels causes unstable retention of the refill, giving rise to a problem of the writing tip rattling.

On the other hand, the latter writing instrument body configuration has no rattling problem at the writing tip because the front barrel and the point assembly are integrally formed, but has a problem of lower ink capacity. More explicitly, since the ink cartridge is fitted to the attachment of the front barrel, the inside diameter of the ink cartridge should be smaller by the thickness of the attachment than the outside diameter of the front barrel, hence the volume of ink to be filled into the cartridge becomes lower. In order to increase the ink capacity of the ink cartridge, it is necessary to make the outside diameter of the attachment greater and so the rear barrel thicker. However, this means increase in differential outside diameter between the front barrel and the attachment, causing the problem of the external appearance of the writing instrument body being spoiled. Further, enlargement of the attachment results in exposure of the attachment beside the cap and the rear barrel, further degrading the external appearance of the writing instrument body.

(Background Art 2)

In some known writing instruments, the outer periphery of the writing instrument body is often printed with the maker name, trade name, model name and the like or covered with a thin film with these printed thereto.

In a case of a writing instrument having a cap as a separate part, the cap is fitted to the rear end of the writing instrument body when it is used.

However, in a case where a writing instrument body having the outer periphery printed with the maker name, trade name, model name and the like or covered with a thin film with these printed thereto is used for writing, the fitting portion of the cap rubs the outer periphery of the writing instrument body every time the cap is fitted to the rear end of the writing instrument body, so that there occurs the problem that the thin film may peel off from its rear end or the print may become faint and patchy.

To deal with this, there are some known conventional configurations in which a stepped portion is formed in the rear part of the writing instrument body so that the cap can be easily fitted while no print is located at that area.

However, these conventional configurations suffer from the problem of complexity in the shape of the writing instrument body and degradation of the external appearance.

(Background Art 3)

As an example of a writing instrument cap, a configuration disclosed in Japanese Utility Model Application Laid-open Sho 57 No. 193587 can be mentioned.

This writing instrument cap has a configuration in which an engaging piece formed with a clip of the cap is press fitted into a vertical hole formed in an projection from the peripheral side of a writing instrument or the like, and the vertical hole is formed so as to have an approximate arc shaped cross-section while the engaging piece of the clip is formed so as to have an approximate rectangular cross-section.

In the assembly work of the writing instrument cap into the writing instrument, it is necessary to make two actions in parallel, i.e., adding a stress on the clip so that it elastically deforms and squeezing the clip into the vertical hole, in order to enable the clip to be held in the vertical hole with the necessary gripping force. Therefore, the fitter needs skill for the assembly work and also suffers from a hard burden on their fingers because a strong force should be applied to a small portion.

Further, in the case where the cross-section of the clip is arc shaped, the clip should be elastically deformed opposing its strong elasticity. In anyway, it is difficult to automate these assembly steps.

Under the consideration of the above conventional problems, it is an object of the present invention to provide a writing instrument which is free from rattling of the point assembly and still can secure a large ink capacity without spoiling the external appearance.

It is another object of the present invention to provide a writing instrument cap which can be fitted without degrading the print on the writing instrument body and yet can be fitted easily without spoiling the external appearance.

It is still another object of the present invention to provide a writing instrument cap which facilitates assembly of a cap body and a clip, no matter what the cross-section of the clip is, can be suitable for automation and yet stylish, as well as providing an assembly method thereof.

DISCLOSURE OF INVENTION

The first aspect of the present invention resides in a writing instrument comprising: a writing instrument body having a refill with a front barrel, and a rear barrel to which the refill is fitted; and a cap as a separate part from the writing instrument body, characterized in that the refill is comprised of the front barrel and an ink tank, the ink tank is accommodated in the rear barrel and removably fitted to the rear barrel, and when the cap is fitted to the writing instrument body, the cap is positioned and fastened to the writing instrument body by abutting an opening end of the cap to a refill attachment side end of the rear barrel.

According to the first aspect of the present invention, in a writing instrument, since the front barrel and the ink tank are formed integrally or as a one-piece structure as a refill (replacement pen element), the outside diameter of the ink tank can be enlarged by making the optimal use of the space inside the rear barrel, whereby it is possible to increase the ink capacity.

Further, since the ink tank is accommodated in the rear barrel and removably fitted to the rear barrel, no rattling of the point assembly will occur even if engagement between the front barrel and the rear barrel becomes loose.

Further, since, when the cap is fitted to the writing instrument body, the cap is positioned and fastened to the writing instrument body by abutting the opening end of the cap to the refill attachment side end of the rear barrel, the appearance of the writing instrument is constituted by the cap and the rear barrel. Accordingly, a stylish appearance can be created when the writing instrument is fitted with the cap, and the step between the front barrel and the rear barrel can be made small, so that it is possible to provide a user-friendly writing instrument.

The second aspect of the present invention resides in the writing instrument defined in the first aspect, wherein the ink tank stores free ink therein, at least part of the ink tank is formed with a transparent or translucent resin material which makes the ink therein visible, and at least part of the rear barrel is formed with a transparent or translucent resin material which makes the ink tank therein visible.

According to the second aspect of the present invention, since the ink tank stores free ink therein, and at least part of the ink tank is formed with a transparent or translucent resin material which makes the ink therein visible, it is possible to monitor the amount of ink.

Since at least part of the rear barrel is formed with a transparent or translucent resin material which makes the interior therein visible, it is possible to monitor the amount of ink in the ink tank therein.

The third aspect of the present invention resides in the writing instrument defined in the first or second aspect, wherein an opening or a transparent portion which makes the ink tank held therein visible is formed at least part of the outer periphery of the rear barrel.

According to the third aspect of the present invention, since at least part of the rear barrel is formed with an opening or a transparent portion which makes the interior visible, it is possible to monitor the amount of ink in the ink tank therein.

The fourth aspect of the present invention resides in the writing instrument defined in any one of the first to third aspects, wherein the cap includes: an inner cap disposed inside the cap so as to be movable in the axial direction of the cap by virtue of an elastic element; and a stroke limiter projectively formed from the front end side of the cap interior so as to oppose the inner cap to limit the movement of the inner cap, and the inner cap has a cylindrical front part in which a stopper portion is projectively formed, whereby the movement of the inner cap is restrained by the abutment of the stopper portion and stroke limiter.

According to the fourth aspect of the present invention, the cap is constructed such that, an inner cap is disposed inside the cap along the axial direction of the cap so as to be movable in the axial direction by virtue of an elastic element, a stroke limiter for limiting the movement of the inner cap is projectively formed from the front end side of the cap interior so as to oppose the inner cap, and the front part of the inner cap is formed in the shape of a cylinder in which a stopper portion is projectively formed in the center of the interior, whereby the movement of the inner cap is restrained by the abutment of the stopper portion and stroke limiter. Therefore, it is possible to prevent excess insertion of the writing instrument body into the cap interior.

The fifth aspect of the present invention resides in the writing instrument defined in any one of the first to fourth aspects, wherein the inner cap is formed of an opaque resin.

According to the fifth aspect of the present invention, since the inner cap is formed of an opaque resin, it is possible to provide a nice-looking cap without allowing the user to see the structure inside the cap.

The sixth aspect of the present invention resides in a writing instrument cap provided separately from a writing instrument body, characterized in that the cap has an approximately cylindrical hollow therein which accommodates a point assembly of the writing instrument and has an inside diameter greater than the outside diameter of the rear part of the writing instrument body, the hollow has a first projected portion formed inwards and circumferentially on an inner wall and a second projected portion formed inwards at a position closer to the cap front than the first projected portion, and when the cap is fitted to a rear part of the writing instrument body, the first projected portion holds an outer periphery of the rear part of the writing instrument body and the second projected portion limits the insertion of a rear end of the rear part of the writing instrument body into the cap interior.

According to the sixth aspect of the present invention, since the inside diameter of the hollow in the writing instrument cap is formed to be greater than the outside diameter of the rear part of the writing instrument body, the cap can be fitted with no occurrence of rubbing between the opening end of the cap and the outer periphery of the rear part of the writing instrument body. Accordingly, some print and the like, if any is formed on the outer periphery in the rear part of the writing instrument body, will never be worn away. Further, since the first projected portion is formed on the inner wall of the cap so as to hold the outer periphery of the rear part of the writing instrument body and the second projected portion is provided so as to limit the insertion of the rear part of the writing instrument body into the cap interior, the influence on the outer periphery of the rear part of the writing instrument body can be minimized without increase in the gripping force of the first projected portion and the cap can be easily fitted to the rear part of the writing instrument body.

The seventh aspect of the present invention resides in the writing instrument cap defined in the sixth aspect, wherein the cap has an inner cap inside the hollow for sealing the vicinity of the point assembly of the writing instrument body, the inner cap is formed so as to be movable inside the hollow along the direction of insertion of the point assembly, by virtue of an elastic element disposed on the front end side in the hollow, and the second projected portion is projectively formed opposing the inner cap.

According to the seventh aspect of the present invention, since the cap is formed with an inner cap inside the hollow for sealing the vicinity of the point assembly of the writing instrument body, and the inner cap is formed so as to be movable inside the hollow along the direction of insertion of the point assembly, by virtue of an elastic element disposed in the hollow on the front end side, the point assembly can be positively sealed and enclosed when the writing tip is housed, and the cap can be fitted softly to the rear part of the writing instrument body, owing to the function of the cushioning element when the cap is fitted.

The eighth aspect of the present invention resides in the writing instrument cap defined in the seventh aspect, wherein the inner cap has a cylindrical front part, a stopper portion opposing the second projected portion is projectively formed inside the cylindrical front part of the inner cap, and the movement of the inner cap is restrained by an abutment of the stopper portion and the second projected portion.

According to the eighth aspect of the present invention, since abutment between the stopper portion and the second projected portion restrains the movement of the inner cap, the rear part of the writing instrument body abuts the inner cap so that it is possible to prevent excess insertion of the rear part of the writing instrument body into the cap interior.

The ninth aspect of the present invention resides in the writing instrument cap defined in seventh or eighth aspect, wherein a gripping force of the rear part of the writing instrument body by the first projected portion is set to be greater than a repulsive force of the elastic element.

According to the ninth aspect of the present invention, since the gripping force of the rear part of the writing instrument body by the first projected portion is set to be greater than the repulsive force of the elastic element, the cap can be fitted softly to the rear part of the writing instrument body, owing to the function of the cushioning element for cap attachment and the cap can be reliably fitted to the rear part of the writing instrument body.

The tenth aspect of the present invention resides in the writing instrument cap defined in any one of seventh to ninth aspects, wherein the elastic element is a coil spring.

According to the tenth aspect of the present invention, use of a coil spring as the elastic element realizes easy spring force setting and simplifies the component configuration.

The eleventh aspect of the present invention resides in a writing instrument cap comprising a cap body and a clip wherein the clip is assembled to the cap body by engagement between an engaging portion formed in the cap body and a hooking portion formed in the clip, characterized in that the engaging portion and hooking portion are constructed so that the engagement between the engaging portion and the hooking portion gradually becomes tight as the clip is slid from a temporal tacking position for temporal tacking of the hooking portion to the engaging portion toward an engagement position where the clip is engaged with the cap body, e.g., in the direction of the axis of the cap body, or the longitudinal direction.

According to the eleventh aspect of the present invention, since engagement of the clip to the cap body can be implemented by sliding the clip from the temporal tacking position where the hooking portion of the clip is temporarily tacked to the engaging portion of the cap body, this arrangement enables easy assembly of the cap body and the clip no matter what the cross-section of the clip is, as well as easy automation.

The twelfth aspect of the present invention resides in the writing instrument cap defined in eleventh aspect, wherein the engaging portion and the hooking portion are constructed so that the hooking portion is temporarily tacked at the temporal tacking position by virtue of at least one of elastic deformation of the hooking portion and the engaging portion when the hooking portion is pressed in a radial direction of the cap body against the engaging portion.

According to the twelfth aspect of the present invention, the clip can be temporarily tacked by a simple action of pressing the clip onto the cap body.

The thirteenth aspect of the present invention resides in the writing instrument cap defined in the eleventh or twelfth aspect, wherein the engaging portion has a tooth engaging piece projectively formed outwards on the top edge of an upright leg, the hooking portion is formed with an engaging tooth to be squeezed and fixed to the upright leg, and either the engaging portion or the hooking portion is formed in a tapered configuration or in a stepped configuration.

According to the thirteenth aspect of the present invention, it is possible to achieve tight engagement between the clip and the cap body.

The fourteenth aspect of the present invention resides in the writing instrument cap defined in the thirteenth aspect, wherein an inclined surface producing a centering effect is formed at least part of the top surface of the tooth engaging piece in the engaging portion.

According to the fourteenth aspect of the present invention, centering can be easily performed by light pressing of the hooking portion of the clip onto the engaging portion of the cap body.

The fifteenth aspect of the present invention resides in the writing instrument cap defined in any of eleventh to fourteenth aspects, wherein a positioning stopper for positioning the engagement position is formed.

According to the fifteenth aspect of the present invention, it is possible to position the engagement position of the clip in an exact manner.

The sixteenth aspect of the present invention resides in the writing instrument cap defined in any of the eleventh to fifteenth aspects, wherein a plurality of projections for preventing the clip from dislodging are formed at, at least one of the engaging portion and the hooking portion.

According to the sixteenth aspect of the present invention, it is possible to increase the strength of engagement as the clip is slid along the direction toward the engagement position, (e.g., in the direction the axis of the cap body, or the longitudinal direction).

The seventeenth aspect of the present invention resides in the writing instrument cap defined in any of the eleventh to sixteenth aspects, wherein the cap body is composed of a crown having the engaging portion projected from an outer peripheral surface and a cap sleeve to be fitted to the writing instrument body, and the crown is formed of a material having a higher rigidity and heat resistance than the cap sleeve.

According to the seventeenth aspect of the present invention, it is possible to improve assembly performance, attachment strength and snap-fit performance.

The eighteenth aspect of the present invention resides in an assembly method of a writing instrument cap for assembling a cap body and a clip by engaging an engaging portion formed on the cap body with a hooking portion formed on the clip, characterized in that the engaging portion and the hooking portion are constructed so that the engagement therebetween gradually becomes tight as the clip is slid from a temporal tacking position for temporal tacking of the hooking portion to the engaging portion toward the engagement position where the clip is engaged with the cap body, and assembly of the cap body and the clip is implemented by temporarily tacking the hooking portion at the temporal tacking position of the engaging portion and enhancing the engagement and fixture gradually as the clip is slid from the temporal tacking position toward the engagement position, e.g., in the direction of the axis of the cap body, or the longitudinal direction).

According to the eighteenth aspect of the present invention, since engagement of the clip with the cap body can be implemented by sliding the clip to the engagement position from the temporal tacking position where the hooking portion of the clip is temporarily tacked to the engaging portion of the cap body, this arrangement enables easy assembly of the cap body and the clip no matter what the cross-section of the clip is, as well as enabling easy automation.

The nineteenth aspect of the present invention resides in the assembly method of a writing instrument cap, defined in the eighteenth aspect, wherein elastic deformation resulting from pressing of the hooking portion against the engaging portion in the radial direction of the cap body is used for temporal tacking to the temporal tacking position.

According to the nineteenth aspect of the present invention, the action of temporal tacking can be easily made.

BEST MODE FOR CARRYING OUT THE INVENTION

[The First Embodiment]

The writing instrument, writing instrument cap and assembly method of the writing instrument cap in accordance with the first embodiment of the present invention will hereinbelow be described in detail with reference to FIGS. 1 to 4.

Figure 1:
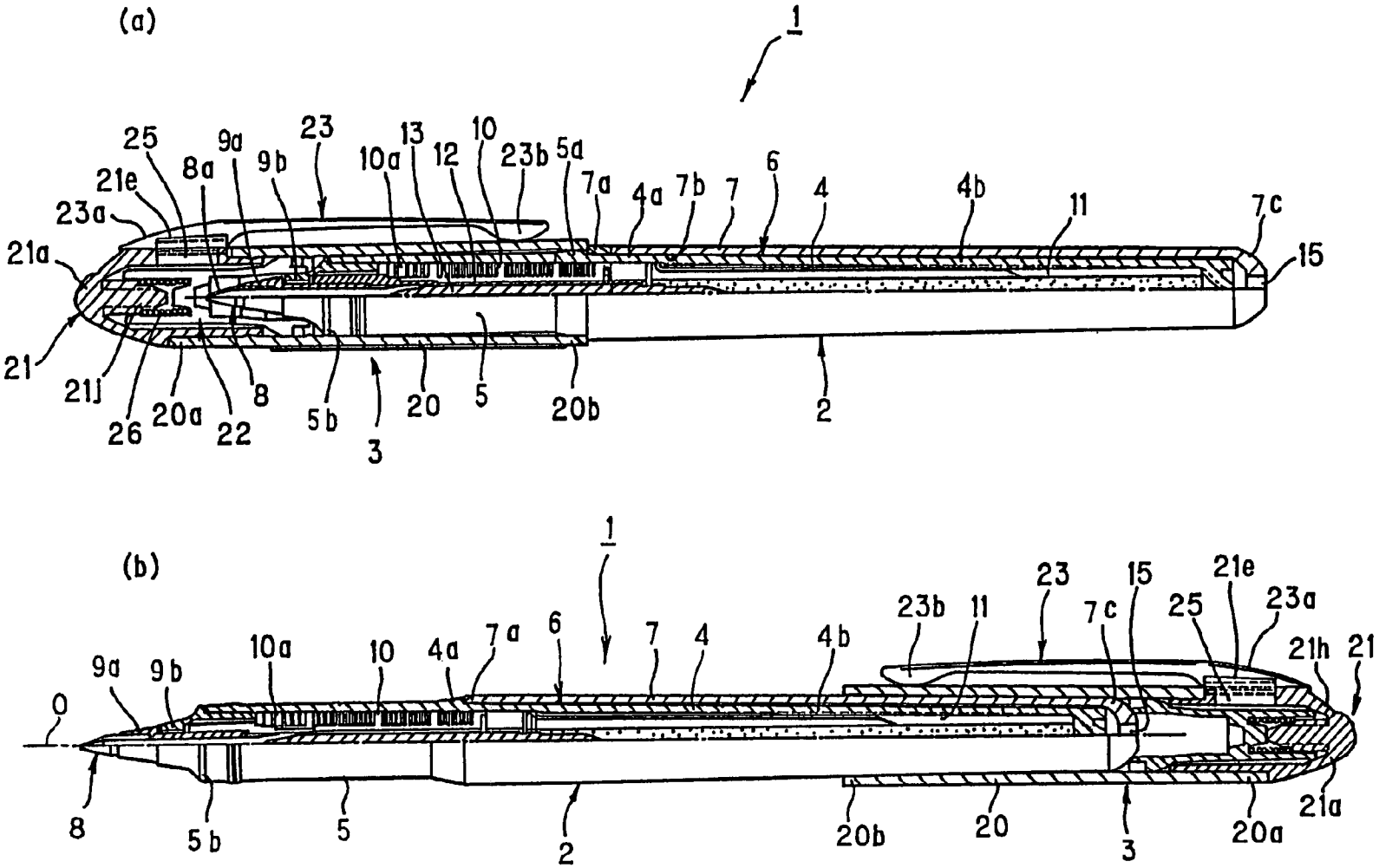
FIG. 1(*a*) is an illustrative view showing an overall configuration of a writing instrument according to the embodiment of the present invention, (*b*) an illustrative view showing the state where the writing instrument is being used.

A writing instrument 1 according to the present embodiment includes a writing instrument body 2 and a writing instrument cap 3 formed as a separate part, as shown in FIGS. 1(*a*) and (*b*).

The writing instrument body 2 is comprised of a refill portion 6 integrally formed of an ink tank 4 filled up with ink therein and a front barrel 5, a rear barrel 7 to which the refill portion 6 is fitted and a point assembly 8 provided in the front part of the refill portion 6.

The rear barrel 7 is adapted to accommodate the ink tank 4 and to be removably attached to the refill portion 6.

Ink tank 4 of refill portion 6 is the part accommodated by rear barrel 7, and front barrel 5 is the part located on the point assembly 8 side or not accommodated by rear barrel 7.

Refill portion 6 may be constructed of an assembled and engaged structure of ink tank 4 and front barrel 5 after separate formation of them as long as it provides the function of a replacement pen element.

The ink tank 4 is formed of transparent resin so as to allow the interior structure and ink to be visible. A threaded portion 4*a* is formed on the outer periphery near the boundary with the front barrel 5 so as to allow the rear barrel 7 to screw fit.

It should be noted that the transparent part of ink tank 4 is located at a position which at least allows the ink inside ink tank 4 to be visible.

The point assembly 8 has a writing tip 8*a* and tip holders 9*a* and 9*b* and is constructed so that writing tip 8*a* is assembled and engaged with front barrel 5 by means of tip holders 9*a* and 9*b*. Accordingly, refill portion 6 and point assembly 8 may constitute a refill (replacement pen element).

Provided inside front barrel 5 in the rear of the point assembly 8 is an ink collector 10, which retains ink to prevent ink leakage.

The ink collector 10 has many annular grooves as retaining grooves 10*a* formed on the outer periphery with a longitudinal groove (not shown) formed to connect the retaining grooves 10*a*. This longitudinal groove is connected to an ink chamber 11 inside ink tank 4 and provides the function of ink passage between ink chamber 11 and retaining grooves 10*a* so that the ink is temporarily stored in retaining grooves 10*a* so as not to blot from point assembly 8 when air inside ink chamber 11 expands due to change in temperature, or the like, and pushes out ink from ink chamber 11. The longitudinal groove also provides the function of returning ink from retaining grooves 10*a* to ink chamber 11 when air inside the ink chamber 11 contracts and reverts back to the original state.

An ink feed insert hole 12 is axially formed in the center of ink collector 10. An ink feed 13 is inserted into this ink feed insert hole 12 and press fitted or loosely fitted in the rear part (the ink chamber side) of the ink feed insert hole 12 while the front end of the ink feed 13 is connected to point assembly 8 so that ink from ink chamber 11 can be supplied to point assembly 8.

Formed on the side surface of ink collector 10 through which ink feed insert hole 12 for attachment of ink feed 13 that feeds ink from ink chamber 11 to point assembly 8 is a vent hole (not shown) connected to the ink feed insert hole 12.

The external shape of the refill portion 6 is constructed so that front barrel 5 located on the front side, in the boundary with the threaded portion 4*a*, is formed to be greater in outside diameter than the rear part 4*b* of ink tank 4, forming a so-called stepped structure. Part of this stepped portion 5*a* toward the front of front barrel 5 is made narrower forming a tapered shape. Rear part 4*b* is made slightly narrower from the threaded portion 4*a* to the rear, forming a tapered shape.

The rear barrel 7 is made of transparent resin so that ink tank 4 incorporated therein is visible, and one end 7*a* is formed to be open. A threaded portion 7*b* is formed on the inside in the position corresponding to the threaded portion 4*a*.

The one end 7*a* is formed to be greater in outside diameter than the stepped portion 5*a*. Illustratively, since the outside edge of the one end 7*a* is located more outside than the outside edge of refill portion 6 when refill portion 6 is screw fitted to the one end 7*a*, the opening end of the cap 3 abuts the opening end of the one end 7*a* so that it serves as a stopper when the cap 3 is fitted.

Thereby, when cap 3 is fitted to the front barrel 5 side of writing instrument body 2, refill portion 6 is covered by the cap 3 and the rear barrel 7, thus only the cap 3 and the rear barrel 7 constitute the exterior of the writing instrument.

Further, the rear barrel 7 has a cylindrical outer shape which is slightly tapered from the one end 7*a* to a rear end 7*c*, and incorporates ink tank 4 therein so as to circumferentially and totally cover the ink tank 4.

Rear end 7*c* of the rear barrel 7 has a closed semispherical configuration having a vent hole 15 at the approximate center thereof for creating communication between the interior of the rear barrel 7 and the exterior.

As has been described heretofore, since, in the present embodiment, ink tank 4 accommodated in the rear barrel 7 and front barrel 5 are formed integrally or as a one-piece structure and handled as a refill (replacement pen element, replacement element), ink can be stored in the space inside refill portion 6, hence a large amount of ink can be stored.

Further, since point assembly 8 is tightly fitted to refill portion 6, no rattling of point assembly 8 will occur.

Since the rear barrel 7 is engaged with the outer periphery of ink tank 4 of refill portion 6, no rattling of point assembly 8 which is attached at the front end of refill portion 6 will occur even if engagement between the rear barrel 7 and refill portion 6 becomes loose.

Further, the outer edge at opening end 7*a* of rear barrel 7 is located concentrically with, and more outside than the outer edge, on the front barrel 5 side, of refill portion 6, so as to provide a stopper function for the cap 3 when the cap is fitted. Accordingly, refill portion 6 is covered by the cap 3 and the rear barrel 7, so that only the cap 3 and the rear barrel 7 constitute the exterior of the writing instrument. Further, since the difference between the outside diameter of cap 3 and the outside diameter of rear barrel 7 can be made small, it is possible to provide a user-friendly writing instrument while the appearance of writing instrument 1 with cap 3 fitted can be made stylish.

Next, the cap 3 will be described in detail.

Figure 2:
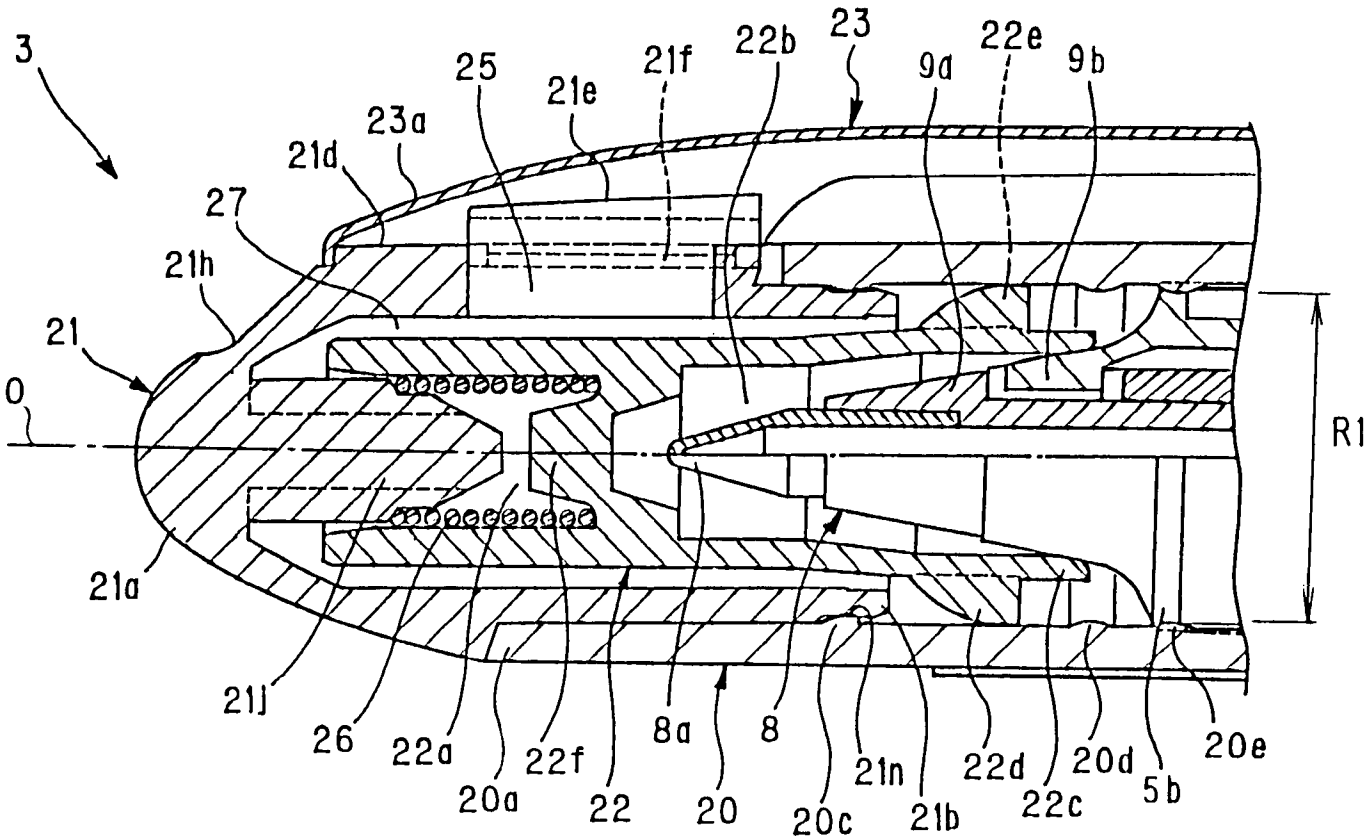
FIG. 2 is a detailed sectional view showing the structure around the point assembly with the writing instrument cap fitted to the writing tip.
Figure 4:
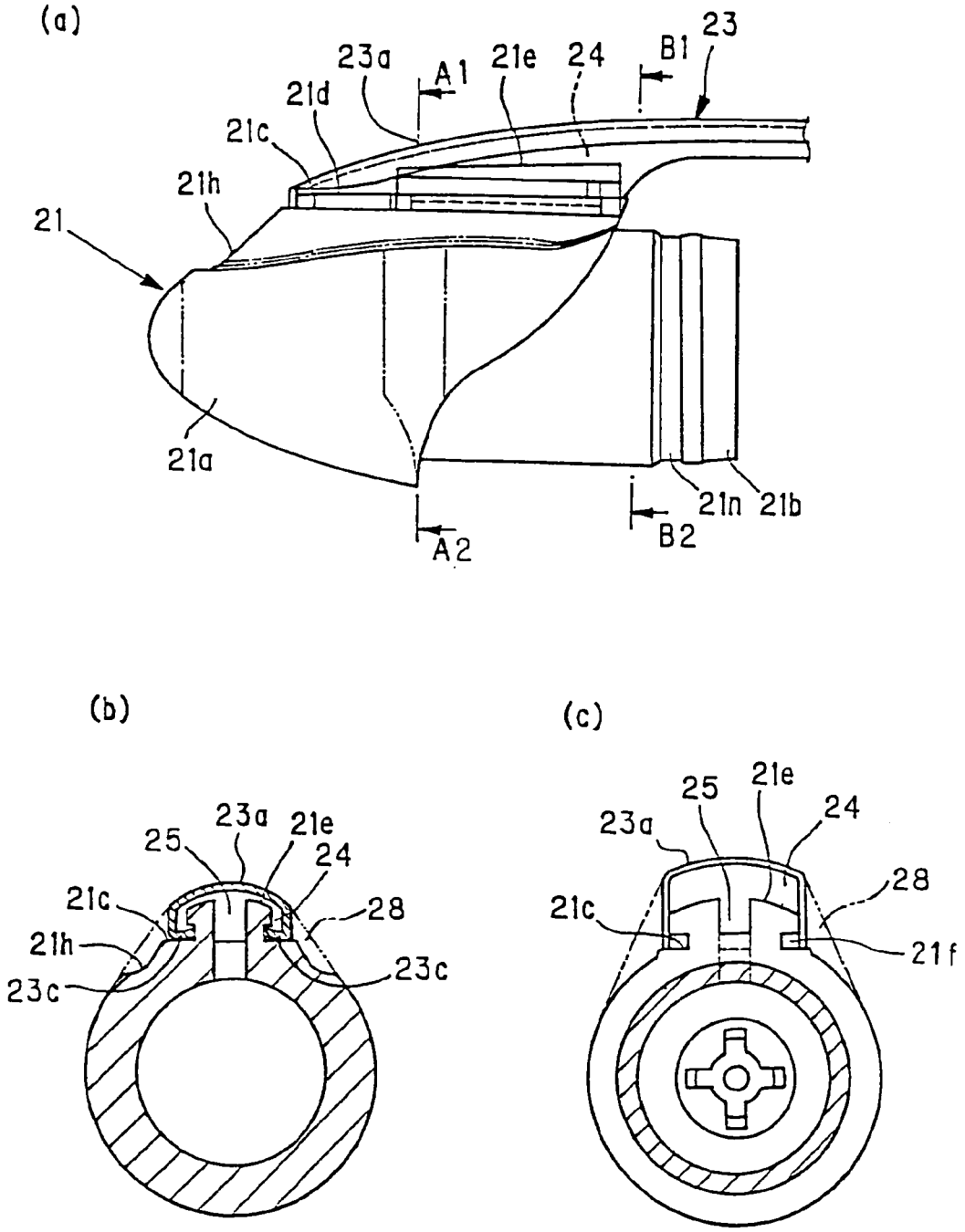
FIG. 4(*a*) is a side view showing the configuration of a crown portion of the writing instrument cap, (*b*) a sectional view cut along a plane A1–A2 in (*a*), and (*c*) a sectional view cut along a plane B1–B2 in (*a*)

As shown in FIGS. 2 and 4(*a*), the cap 3 is comprised of a cap body 20 and a crown portion 21, which are separate parts and removably joined. An inner cap 22 is arranged on the crown portion 21 side, inside cap 3, while a clip 23 is provided as a separate part on the outer side of the crown portion 21.

To begin with, cap body 20 of cap 3 will be described.

Cap body 20 is made of colored opaque resin and approximately cylindrical, having a front opening 20*a* (FIGS. 1 and 2) at one end to which crown portion 21 is fitted and a rear opening 20*b* (FIG. 1) at the other end to which stepped portion 5*a* of the front barrel 5 is fitted.

As shown in FIG. 2, inside the front opening 20*a*, a crown hold 20*c* for holding and fixing crown portion 21 and an inner cap hold 20*d* for preventing inner cap 22 from dislodging are formed projectively inwards and continuously along the circumference.

Figure 3:
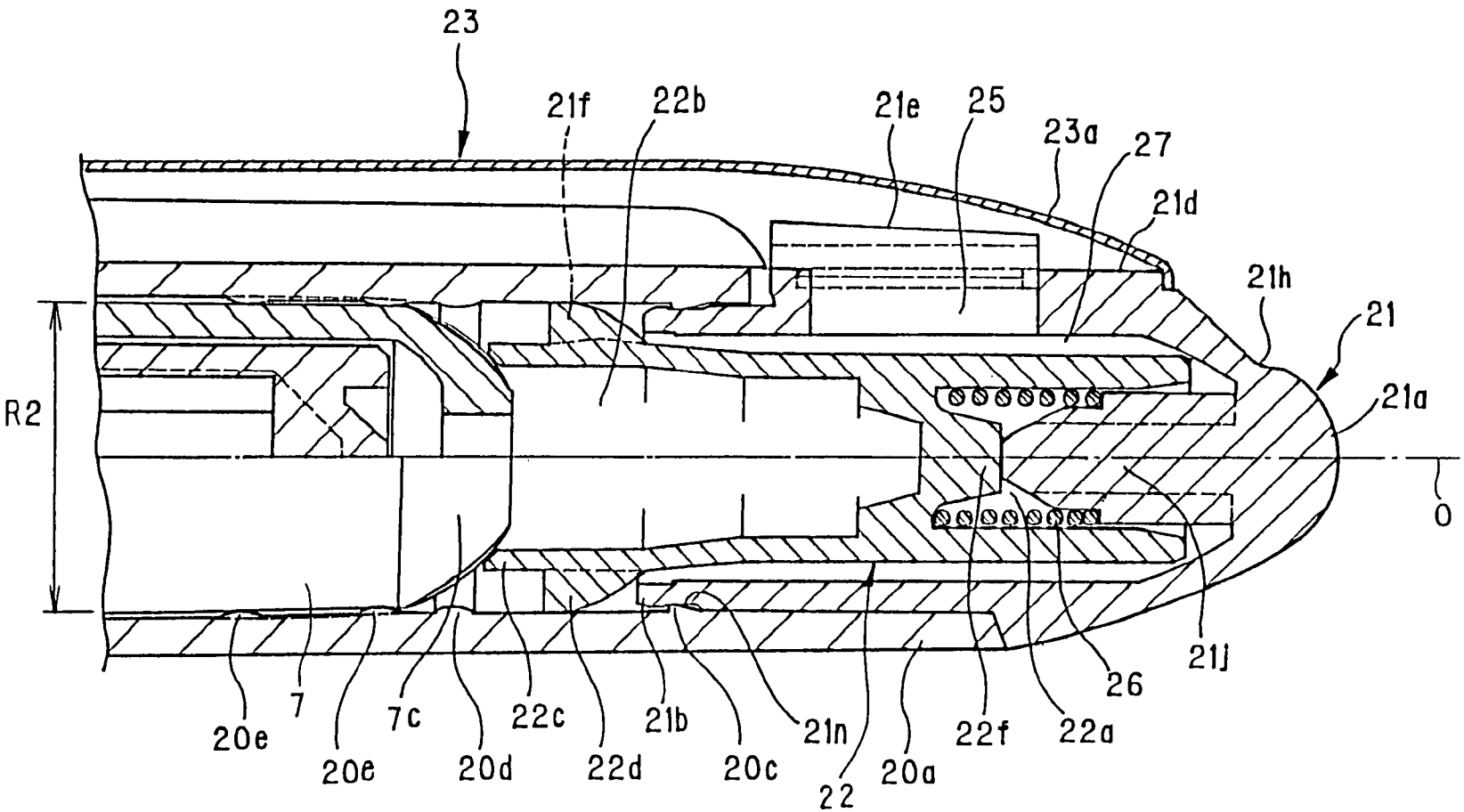
FIG. 3 is a detailed sectional view showing the structure around the rear end of the writing instrument with the writing instrument cap fitted to the rear end.

In addition, two rows each having a multiple number of inwardly projected barrel holds 20*e*, as the first projected portion, for holding a tip side end 5*b* of front barrel 5 to be inserted, are formed on the inner side of the front opening 20*a*, along the circumference (FIG. 3).

The projected height of the barrel holds 20*e* is specified so that the diameter R1 (FIG. 2) of a circle (imaginary circle) circumscribed with all the peaks of the projections is marginally smaller than the outside diameter R2 (FIG. 3) of rear barrel 7 on the rear end 7*c* side. It should be noted that cap body 20 is formed so as not to be broken when it is deformed due to dimensional difference between the diameter R1 of the circle and the outside diameter R2 of rear barrel 7 on the rear end 7*c* side.

The frictional force arising over the rear end surface from repulsive force of the deformation of the barrel holds 20*e* and rear barrel 7 is specified so as to be marginally greater than the spring force of coil spring 26. This prevents cap 3, when fitted on rear barrel 7 of writing instrument body 2, from falling off from rear barrel 7 due to the spring force of coil spring 26 which acts in such a direction that cap 3 comes off from rear barrel 7.

The inside diameter of the rear opening 20*b* (FIG. 1) of the cap 3 is formed to be slightly smaller than the outside diameter of the stepped portion 5*a*, so that a tight fit is formed when cap 3 is fitted to writing instrument body 2.

Next, crown portion 21 of cap 3 will be described with reference to FIG. 2 and FIG. 4(*a*).

The crown portion 21 is formed of colored opaque resin, in the shape of an approximate cylinder having a front end 21*a* formed in an approximate semispherical shape or approximate bullet shape and an opening on the other end 21*b* side. The crown portion has a hollow in which inner cap 22 is arranged.

A guide portion 21*j* (the second projected portion) also functioning as a stroke limiter, for guiding the inner cap 22 while limiting the stroke length of the inner cap is projected to the other end 21*b* side (rearwards) in the direction of an axis O from part of the interior wall of the front end 21*a*.

The outside diameter of the cylinder at the other end 21*b* is specified to be approximately equal to the inside diameter of front opening 20*a* of the cap body 20. Further, a notch 21*n*, e.g., groove, cutout, etc., is formed on the outer periphery of the other end 21*b*, continuously along the circumference, at a position corresponding to the crown hold 20*c* on the inner periphery of the front end 20*a* when the front end 21*a* is fitted to the front opening 20*a* of the cap body 20.

Further, formed on the outer surface of crown portion 21 are, as shown in FIG. 2 and FIG. 4(*a*), an attachment surface 21*c* on which the edges of clip 23 are attached, a stopper portion 21*d* for positioning the clip 23, a clip attachment 21*e* which engages the clip 23 and a depressed portion 21*h* formed in the longitudinal direction on the outer peripheral surface of crown portion 21, creating an air passage.

The attachment surface 21*c* is a surface on which clip 23 is fitted, and is formed on the outer side portion of the crown portion 21 in its approximate middle part with respect to the longitudinal direction so as to be flat and substantially parallel to the direction of the axis O.

The stopper portion 21*d* is a stopper which is located on the upper side of the attachment surface 21*c* and abuts the inner surface of clip 23 and positions the clip 23, and is projectively formed approximately parallel to the attachment surface 21*c*.

The clip attachment 21*e*, as shown in FIGS. 4(*a*) to (*c*), is an attachment portion formed on the top of the attachment surface 21*c* so as to be higher than the stopper portion 21*d* and has guide grooves 21*f* formed on the left and right flanks of the raised portion from the attachment surface 21*c*, so that they sink in the width direction.

Further, as shown in FIGS. 4(*b*) and (*c*), the clip attachment 21*e* has a vent hole 25 which establishes communication between the interior space of crown portion 21 and the outside, in the approximate middle part thereof. The vent hole 25 has a rectangular cross-section (along the direction of axis O) elongated in the direction of axis O.

Clip attachment 21*e* may be formed either integrally with the crown portion 21 or separately from the crown portion 21.

Formed on the outer part of the crown portion 21 is depressed portion 21*h* which is depressed along the contour of the area of crown portion 21 to which clip 23 is attached.

Depressed portion 21*h* is so formed as to become closer to the axis O as it goes toward the front end 21*a* side and become more distant from the axis O as it goes to the other end 21*b*.

As has been described, since depressed portion 21*h* is formed along the contour of the clip attachment 21*e* so that the depressed portion 21*h* creates an air passage 28 in the front end 21*a*-to-rear end 21*b* direction and in the front end 21*a*-to-vent hole 25 direction as shown in FIGS. 4(*b*) and (*c*), it is possible to enhance ventilation in corporation with vent hole 25 which is formed on the outer periphery of crown portion 21, even when writing instrument cap 3 is accidentally swallowed.

Next, clip 23 will be described in detail.

Clip 23 is formed of metal so that its length is shorter than the length of cap 3, as shown in FIG. 1. Clip 23 has an attachment portion 23*a* for attachment to cap 3 and a free end 23*b* at the end opposite to the attachment portion 23*a*.

The attachment portion 23*a*, as shown in FIG. 2 and FIGS. 4(*a*) to (*c*), covers clip attachment 21*e* and is formed with an arc edge portion in conformity with the contour of the attachment surface 21*c*.

Of the edge portion of attachment portion 23*a*, edges opposing the side walls of the clip attachment 21*e* are bent so as to have an approximate L-shaped section, forming a gripping portion 23*c*, which can be engaged with guide grooves 21*f*. Accordingly, of the edge portion of attachment portion 23*a*, the part which does not oppose the side walls of clip attachment 21*e* is formed in an inverted U-shape (bottom opening U-shape), in the vertical section cut along a plane that is perpendicular to axis O, as shown in FIG. 4(*c*).

The opposing part of attachment portion 23*a* to the clip attachment 21*e* has an approximate C-shaped section (bottom-opening C) when viewed from the side (FIGS. 4(*b*) and (*c*)).

When clip 23 is attached in place to the clip attachment 21*e*, a clearance is formed between the clip attachment 21*e* and attachment portion 23*a*, forming an air passage 24, as shown in FIGS. 4(*b*) and (*c*). Air passage 24 establishes communication between vent hole 25 and crown portion 21 and also makes communication between vent passage 25 and depressed portion 21*h*.

Next, inner cap 22 provided inside crown portion 21 will be described.

The inner cap 22, as shown in FIG. 2, has the outside shape of an approximate cylinder having an outside diameter smaller than the inside diameter of the hollow of crown portion 21, creating a space between the outer peripheral wall of the inner cap 22 and the inner peripheral wall of the crown portion 21, thus forming an air passage 27. The air passage 27 is connected to the outside of cap 3 by way of the vent hole 25.

The inner cap 22 has a guide hole 22*a* at one end, into which guide portion 21*j* of crown portion 21 is inserted. Coil spring 26 is arranged in the guide hole 22*a*. The other end of inner cap 22 is formed with a hollow 22*b* in which point assembly 8 is accommodated.

Inner cap 22 is formed so that writing point 8*a* is kept out of contact with the inner wall of inner cap 22 while part of the outer periphery of the point assembly 8 abuts the opening rim 22*c*.

Projected from the bottom of the guide hole 22*a* toward the opening side is a stopper portion 22*f*, which is positioned so as not to abut the guide portion 21*j* when point assembly 8 is accommodated in place in cap 3.

Inner cap 22 has a plurality of guide vanes 22*d* projectively formed on its outer periphery closer to the end 22*c* and arranged circumferentially. These guide vanes guide the inner peripheral wall of cap body 20, so that the outer peripheral wall of inner cap 22 will be kept out of contact with the inner peripheral wall of cap body 20 and so that inner cap 22 can be slid. Air channels 22*e* are defined between adjoining guide vanes 22*d* so as to establish communication between the cap's front end 21*a* side and the writing element 1 side inside the inner cap 22. Thereby the space on the writing element 1 side of cap 3 is adapted to communicate with the front space of cap 21 by way of air channels 22*e*, air passage 27, vent hole 25, air passage 24 and depressed portion 21*h*.

Next, attachment of the writing instrument cap of the present embodiment will be described.

When writing instrument 1 is unused, cap 3 is fitted on point assembly 8 of writing instrument 1 so as to avoid exposure of point assembly 8 or its accidental staining, as well as to avoid drying of the writing point.

In this state, cap 3, as shown in FIG. 1(*a*) and FIG. 2, is fitted on and held by ink tank portion 4 in such a manner that rear opening 20*b* fits stepped portion 5*a* of front barrel 5 while abutting one end 7*a* of rear barrel 7 and tip side end 5*b* fits with barrel holds 20*e*. Point assembly 8 inside cap 3 is positioned so as to thrust inner cap 22 against crown portion 21.

The inner cap 22 is urged against point assembly 8 by means of coil spring 26 while guide portion 21*j* of crown portion 21 is kept out of contact with stopper portion 22*f* of the inner cap 22 (FIG. 2). By this arrangement, opening rim 22*c* seals point assembly 8 so as to hermetically keep the writing point inside the hollow 22*b*.

On the other hand, when writing instrument 1 is used, cap 3 is removed from the front end of writing instrument body 2 and attached to the rear end of the writing instrument body 2.

In this situation, cap 3 is attached to rear barrel 7 in such a manner that a tight fit is formed between barrel holds 20*e* and rear barrel 7 on the rear end 7*c* side while inner cap 22 is thrust by rear end 7*c*, as shown in FIG. 1(*b*) and FIG. 3.

In this case, rear end 7*c* presses coil spring 26 so as to push inner cap 22 into cap 3 until stopper portion 22*f* abuts guide portion 21*j* of crown portion 21, whereby the cap is attached in the predetermined position in the rear end of rear barrel 7 (FIG. 3).

In accordance with the first embodiment, since one end 7*a* of rear barrel 7 is formed to be greater in outside diameter than stepped portion 5*a* of refill portion 6, the end portion of the cap abuts the end of one end 7*a* when cap 3 is fitted, so as to serve as a so-called stopper, whereby it is possible to fit cap 3 to writing instrument body 2 in a reliable manner. Further, since the dimensional difference between the outside diameter of cap 3 and the outside diameter of rear barrel 7 can be made small, it is possible to provide a user-friendly writing instrument while the appearance of writing instrument 1 with cap 3 fitted can be made stylish.

Since part or whole of rear barrel 7 is formed of transparent resin, the amount of ink remaining in the ink tank which is accommodated inside the rear barrel 7 can be monitored easily.

Since cap 3 is formed of colored opaque resin, it is possible to realize a stylish writing instrument which looks pleasant without allowing the user to see the complicated structure of ink collector 10 inside front barrel 5 and the sealing structure of the writing point inside cap 3 when the writing instrument is unused.

Inner cap 22 is constructed so that stopper portion 22*f* is projected from the bottom of guide hole 22*a* toward the opening side and positioned so as not to abut the guide portion 21*j* when point assembly 8 is accommodated in place in cap 3 (FIG. 2). Further, inner cap 22 is so configured that, when rear end 7*c* of rear barrel 7 is fitted into cap 3 (FIG. 3), the inner cap 22 can be pushed into cap 3 in the direction in which coil spring 26 contracts, by the thrust from rear end 7*c* until stopper portion 22*f* abuts guide portion 21*j* (the second projected portion) of crown 21. Therefore, rear end 7*c* of rear barrel 7 can be fitted and placed at the predetermined position, without excess insertion of rear end 7*c* of rear barrel 7 into cap 3.

In the first embodiment, rear barrel 7 is formed of transparent resin so that the interior of rear barrel 7 is visible. However, the rear barrel may be formed of an opaque substance, for example, (and may even be formed of metal). In this case, it is preferred that a monitor window through which the interior of rear barrel 7 can be seen is formed so that the amount of ink remaining in the ink tank can be monitored.

Further, in the present embodiment, air passages 24 and 21*f* are formed in cap 3, but this cap configuration should not limit the invention.

Since barrel holds 20*e* as the first projected portion are formed inside cap body 20, it is possible to set the cap to rear end 7*c* side of rear barrel 7 with a simple structure, leaving it as, substantially, a simple cylinder without forming anything on the outer periphery of rear barrel 7, or without spoiling the external appearance.

Since two rows, each including a plurality of barrel holds 20*e* projected inwards, are formed apart with respect to the axial direction, rear barrel 7 on the rear end 7*c* side can be gripped by two stages, so that the shock when cap 3 is fitted can be reduced, whereby it is possible to realize smooth fitting.

Since inner cap 22 is arranged inside cap 3 with coil spring 26 interposed therebetween and the frictional force arising over the rear end surface from repulsive force of the deformation of the barrel holds 20*e* and rear barrel 7 is specified so as to be marginally greater than the spring force of coil spring 26, it is possible to set the cap to rear barrel 7 on the rear end 7*c* side in a reliable manner, never causing cap 3 to dislodge due to inferiority of gripping force of the cap to the spring force when cap 3 is fitted.

It should be noted that, in the first embodiment, two rows of barrel holds 20*e* are formed apart with respect to the axial direction, on the inner side of cap body 20, the number of rows of barrel holds and their configuration should not be limited thereto. For example, a single row of projections may be possible. In this case, the cap body configuration can be further simplified, so a further cost reduction can be made.

In the above description of the embodiment, barrel holds 20*e* tightly hold rear barrel 7 on the rear end 7*c* side, but it is possible to provide a configuration in which barrel holds 20*e* tightly hold rear end 7*c* itself.

Further, coil spring 26 is used as an actuating means for inner cap 22, but the invention should not be limited thereto. For example a rubber element may be interposed between cap 3 and inner cap 22 so that rubber elasticity is used to motivate the inner cap 22.

The present invention should not be limited to the above illustrated example, but various changes and modifications can be of course added without departing from the scope of the present invention.

[The Second Embodiment]

The writing instrument, writing instrument cap and assembly method of the writing instrument cap into the writing instrument, in accordance with the second embodiment of the present invention will hereinbelow be described in detail with reference to FIGS. 5 to 11.

Figure 5:
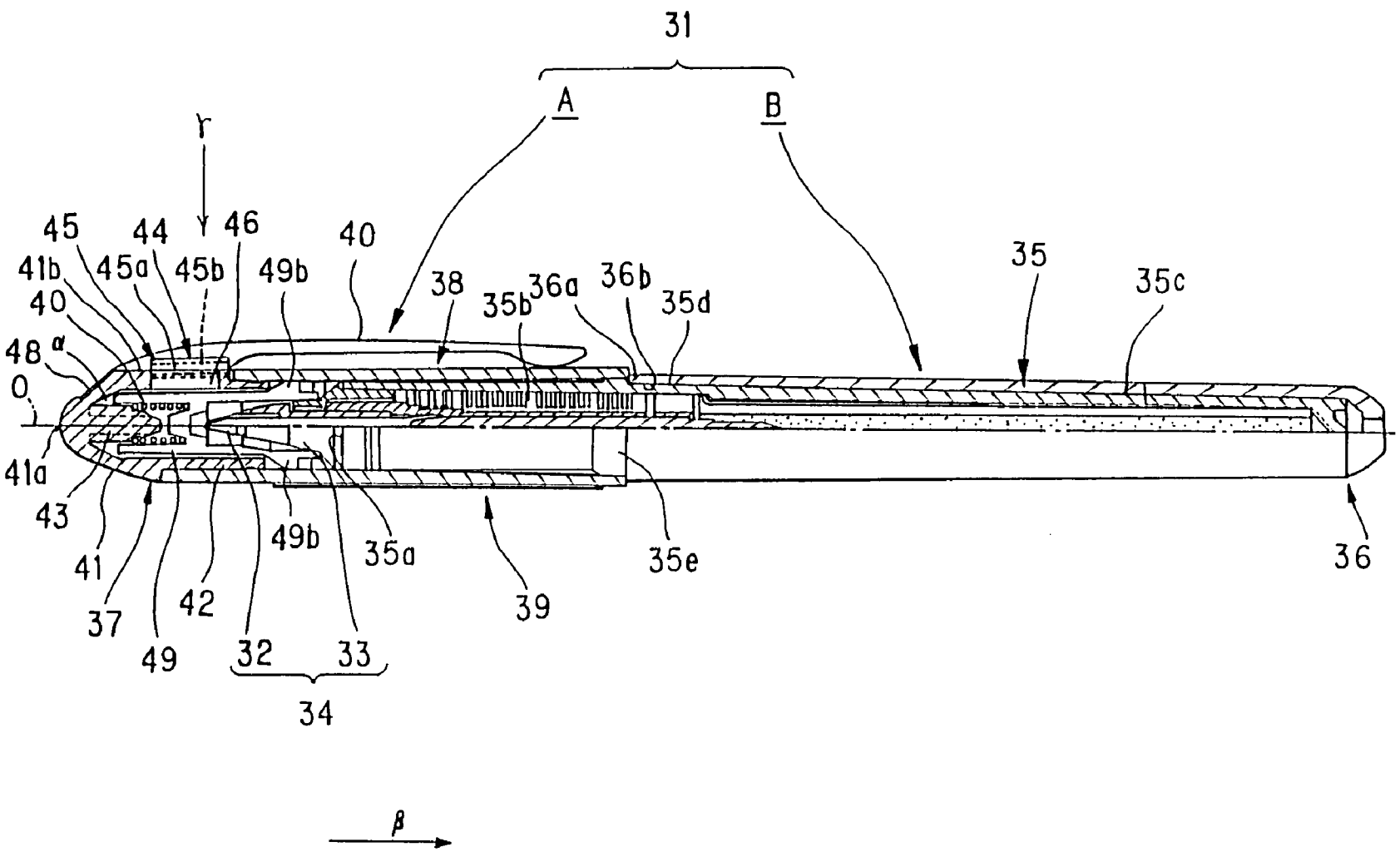
FIG. 5 is an illustrative view showing the overall configuration of a writing instrument with one embodiment of a writing instrument cap of the present invention fitted to the writing tip side of the writing instrument body.

As shown in FIG. 5, writing instrument 31 is comprised of a writing instrument cap A and a writing instrument body B.

The writing instrument body B is formed of a barrel cylinder 35 and a cylindrical exterior body 36, wherein barrel cylinder 35 is inserted into cylindrical exterior body 36 and threaded portions 35*d* and 36*b* are screw fitted to each other.

Barrel cylinder 35 has a front opening 35*a* in which a point assembly 34 having a writing point 32 supported by a holder 33 is fitted, and incorporates an ink collector portion 35*b* in the front half adjacent to the point assembly 34 side and an ink tank portion 35*c* in the rear half behind the front half. A threaded portion 35*d* is formed on the outer peripheral wall surface in the front end of ink tank portion 35*c*.

Cylindrical exterior body 36 has a threaded portion 36*b* formed on the inner peripheral wall surface in a front end opening 36*a* and is sized lengthwise so as to accommodate the rear half of the barrel cylinder 35, e.g., ink tank portion 35*c*.

Figure 6:
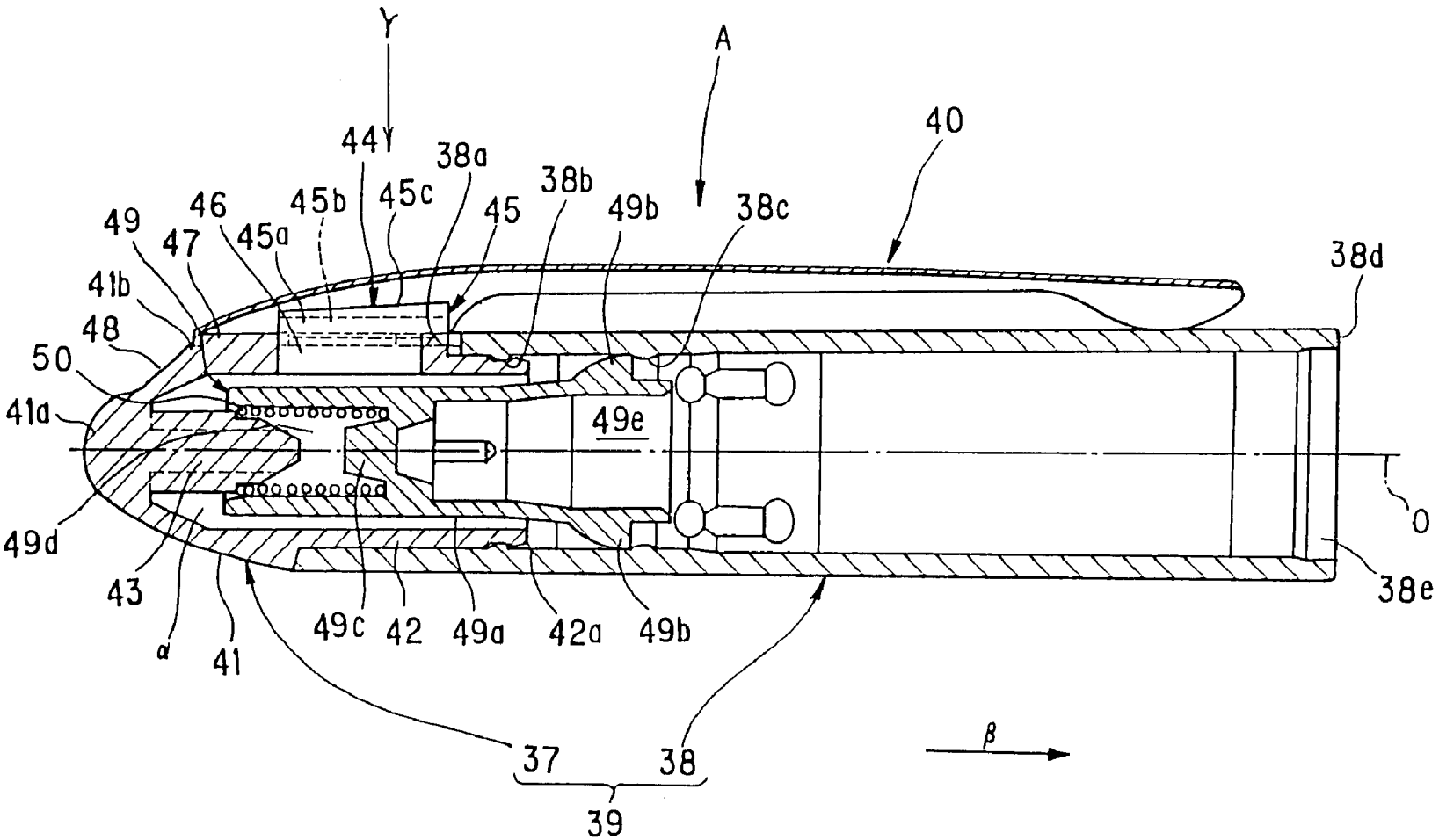
FIG. 6 is an enlarged view of the above writing instrument cap.

Writing instrument cap A, as shown in FIGS. 5 and 6, includes a cap body 39 of a crown 37 and a cap sleeve 38 fitted together, an inner cap 49 provided between crown 37 and cap sleeve 38 and a clip 40 attached to cap body 39. Crown 37, cap sleeve 38, inner cap 49 and clip 40 are all formed separately.

Cap sleeve 38 is formed on its inner peripheral wall surface in a front opening 38*a* (FIG. 6) with a projected, annular crown hold 38*b* for engaging crown 37 and a projected annular inner cap hold 38*c* for preventing inner cap 49 from dislodging from cap body 39.

Formed on the inner peripheral wall surface in a rear opening 38*d* of cap sleeve 38 is a step 38*e* which comes into tight contact with a stepped portion 35*e* formed between ink collector portion 35*b* and ink tank portion 35*c* in barrel cylinder 35.

Cap sleeve 38 is made from a synthetic resin such as relatively soft PP(polypropylene), PE(polyethylene), PET (polyethylene), CO-PET(a resin mixture consisting of polyethylene as a main component and a relatively large amount of other resins (e.g., poly-cyclohexanedimethanol (PCT))), ABS, cellulose resin, vinyl chloride, PMMA(polymethylmethacrylate), or the like.

As shown in FIGS. 5 to 9, crown 37 has a fitting sleeve 42 which is projected along the axis O from the rear of a swollen part 41 and to be inserted into front opening 38*a* of cap sleeve 38, forming a cylindrical hollow a therein.

Crown 37 is formed of a synthetic resin such PC/PET (polymer alloy of polycarbonate and polyethylene terephthalate), PC/ABS(polymer alloy of polycarbonate and ABS), ABS, PP(polypropylene), PE(polyethylene), PS(polystyrene), PET(polyethylene), PMMA(polymethyl-methacrylate), or the like.

A supporter 43 for supporting inner cap 49 is formed in the hollow α, projectively along the axis O from the front side inner wall surface of crown 37.

Supporter 43 has a support shaft having a smaller outside diameter so as to allow a spring 50 to be engaged and fitted at the front end side thereof. Here, supporter 43 has a cross-shaped section (FIG. 7(*c*)), when cut along a plane perpendicular to the axis O.

Swollen part 41 has an approximately bullet shape made up of a semispherical projection 41*a* on the front most side with the outside diameter at the rear end made approximately equal to the outside diameter of front opening 38*a* of cap sleeve 38. Part of the outer peripheral surface of swollen part 41 is formed flat, constituting an attachment surface 41*b* from which an engaging portion 44 is projected.

Fitting sleeve 42 is formed in the shape of a cylinder having an outside diameter approximately equal to the inside diameter of the cap sleeve 8. A notch 42*a* in the form of an annular groove or cutout that mates crown hold 38*b* is formed in the vicinity of the opening rim of fitting sleeve 42.

Engaging portion 44 is an engaging portion to engage clip 40 and is composed of guide elements 45 and a vent hole 46.

A pair of guide elements 45, 45 are comprised of upright legs 45*a*, 45*a* having gently serrated outer flanks, a pair of teeth engaging pieces 45*b*, 45*b* disposed on the tops of upright legs 45*a*, 45*a*, projected outwards beyond the upright legs 45*a*, 45*a* and functioning as guide elements. These guide elements are formed along the axis O, spaced, one from the other, by the necessary distance (vent hole 46).

With the aforementioned pair of guide elements 45, 45, as engaging teeth 51*a*–51*c* of clip 40 are pressed against teeth engaging pieces 45*b*, 45*b*, the engaging teeth cross over teeth engaging pieces 45*b*, 45*b* by virtue of the elastic action of the pair of guide elements 45, 45 and become engaged with upright legs 45*a*, 45*a*.

More illustratively, guide elements 45, 45 are constructed so that they can temporarily tack clip 40 when clip 40 is pushed inwards with respect to the radial direction γ, or by a weak pressure or a single-touch fitting making use of elasticity, namely snap fitting with a weak force for attachment.

Figure 9:
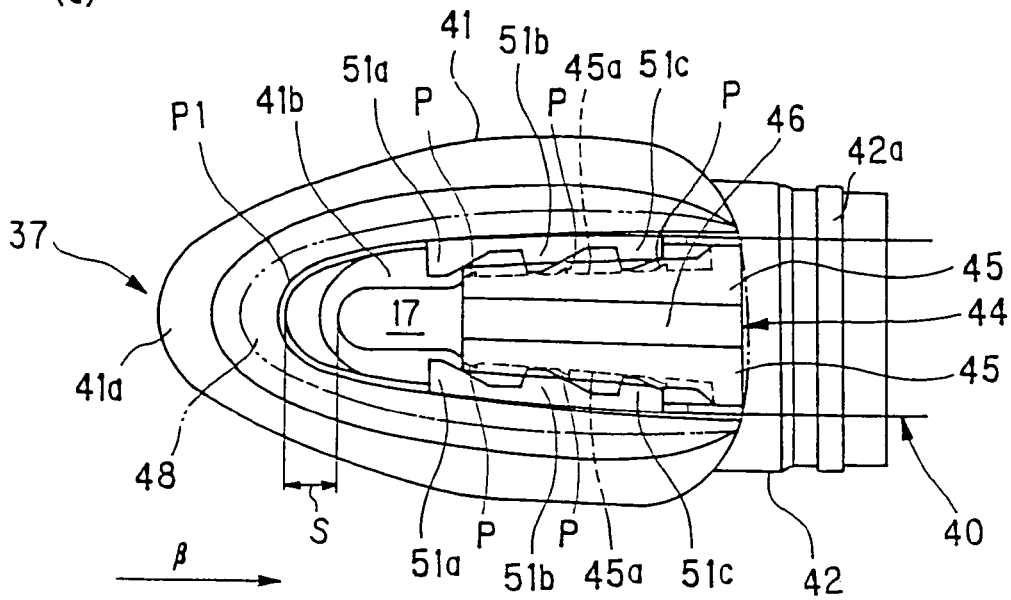
FIG. 9(*a*) is a plan view showing the state where a clip is temporarily tacked to a cap body, (*b*) a plan view showing the state where the clip has been fitted.
Figure 9:
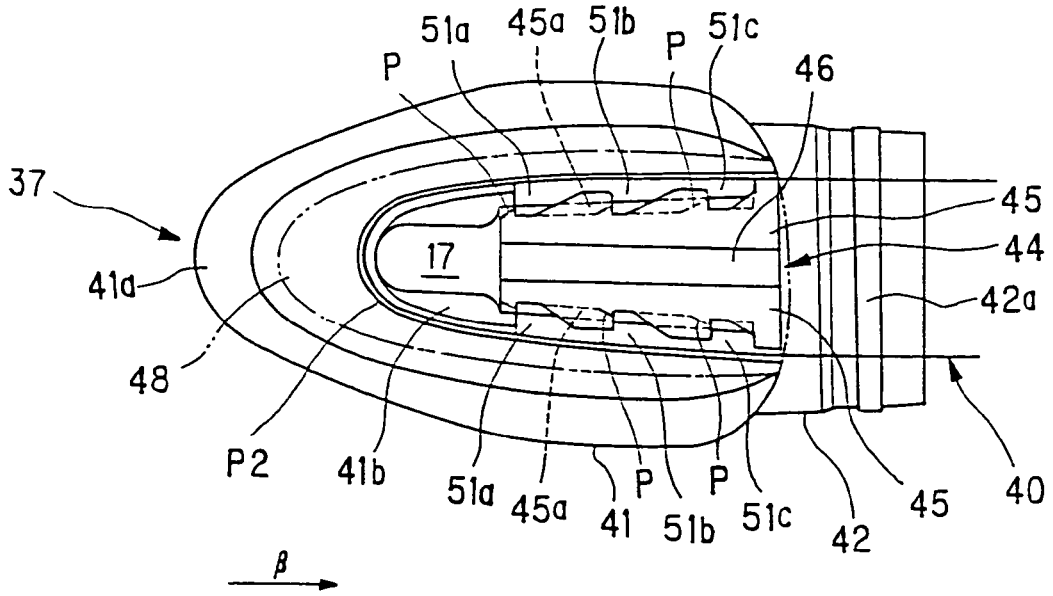

Upright leg 45*a* as well as teeth engaging piece 45*b* is obliquely constructed (FIGS. 9(*a*) and (*b*)) so that the outer edge becomes apart from the inner edge confronting vent hole 46, spreading outwards from the upstream end to the downstream end with respect to the direction β of insertion of clip 40 (FIG. 5(*a*), FIGS. 4(*a*) and (*b*)). In other words, a pair of guide elements 45, 45 are formed so that their outer edges are tapered with respect to a plane.

Figure 7:
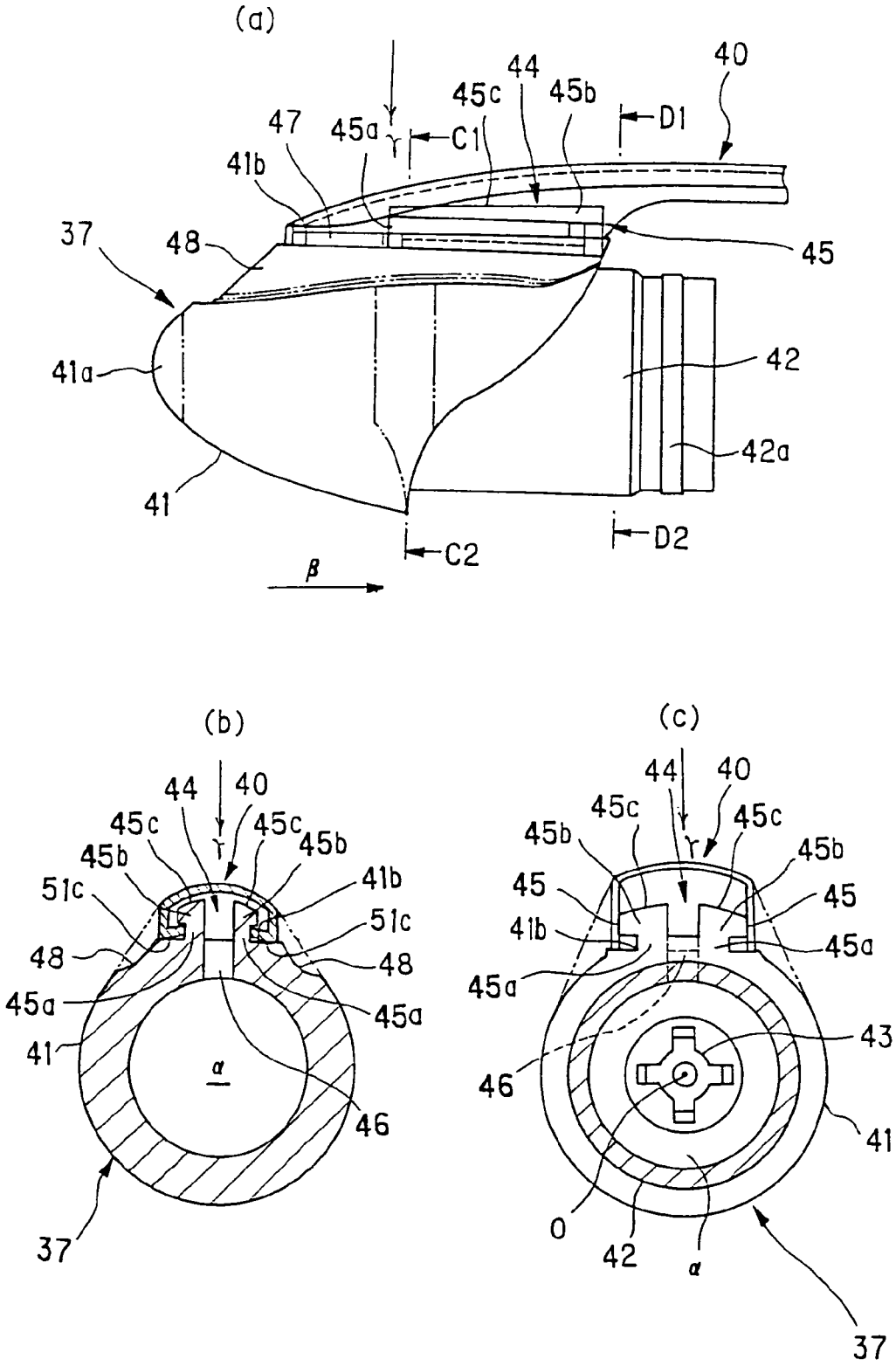
FIG. 7 shows a crown of the above writing instrument cap, (*a*) is a side view thereof, (*b*) a sectional view cut along a plane C1–C2 in (*a*), (*c*) a sectional view cut along a plane D1–D2 in (*a*)

Teeth engaging pieces 45*b*, 45*b* constitute a wedge-like configuration so that the thickness gradually becomes greater from the upstream end to the downstream end with respect to the direction β of insertion of clip 10 (FIG. 7).

The flank of upright leg 45*a* is formed with a plurality of serrated shallow projections P with a predetermined pitch (FIGS. 9(*a*) and (*b*)).

Figure 8:
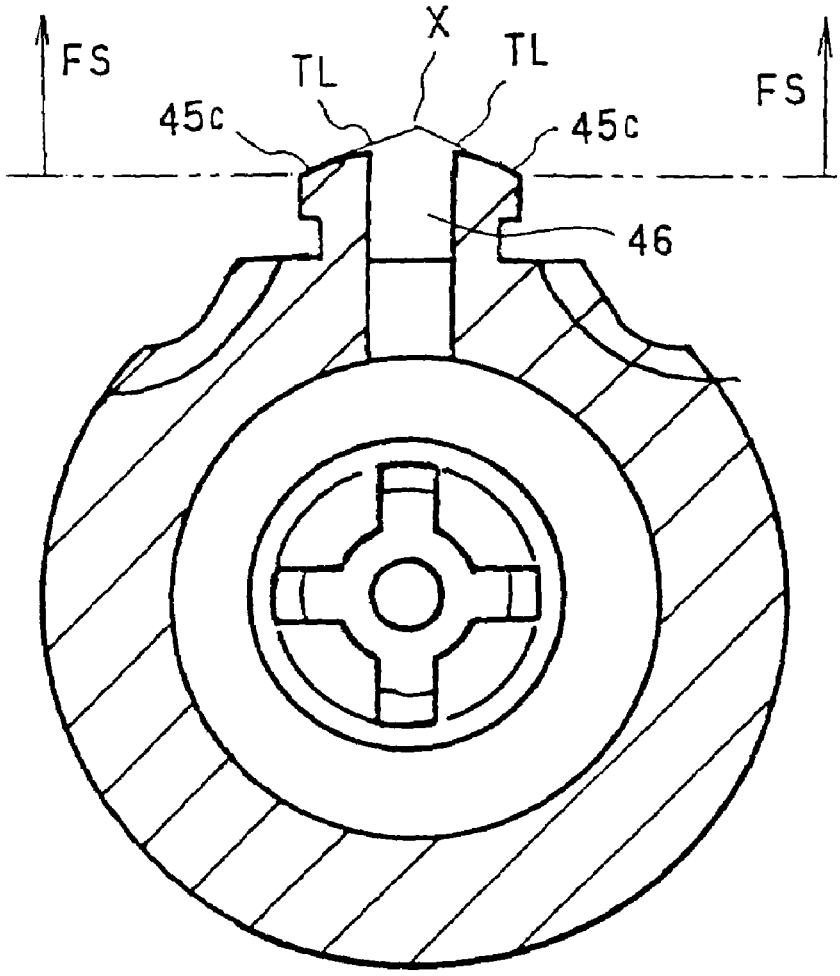
FIG. 8 is an illustrative view showing a top surface 15*c* of teeth engaging pieces 15*b;*

As shown in FIGS. 7(*a*) to (*c*) and FIGS. 9(*a*) and (*b*), top surfaces 45*c* of teeth engaging pieces 45*b* are formed as inclined surfaces producing a centering effect. Specifically, a pair of top surfaces 45*c*, 45*c* are formed with such inclined surfaces that, as shown in FIG. 8, the point of intersection X between the two tangent lines TL will be located within the space for attachment of clip 40 or within the space FS on the front side of top surfaces 45*c* (FIG. 8). Here, it should be understood that space FS does not contain the space of vent hole 46 located between teeth engaging pieces 45 and 45.

Top surface 45*c* may be totally or partly formed of a plane or curved surface.

For example, when a pair of top surfaces 45*c* and 45*c* are flat, the paired top surfaces 45*c* and 45*c* constitute a tapered configuration. When a pair of top surfaces 45*c* and 45*c* are curved, they constitute an approximately inverted U-shaped configuration or arch-like (bottom opening approximately C-shaped) configuration. Even when one of the pair of top surfaces 45*c* and 45*c* is a flat surface and the other is a curved surface, the centering effect can be obtained.

Vent hole 46 is a hole for ventilation having approximately rectangular cross and vertical sections for communication between the hollow α inside crown 37 and the outside, and is formed between the guide elements 45 and 45 with almost the same length as that of guide elements 45.

Figure 10:
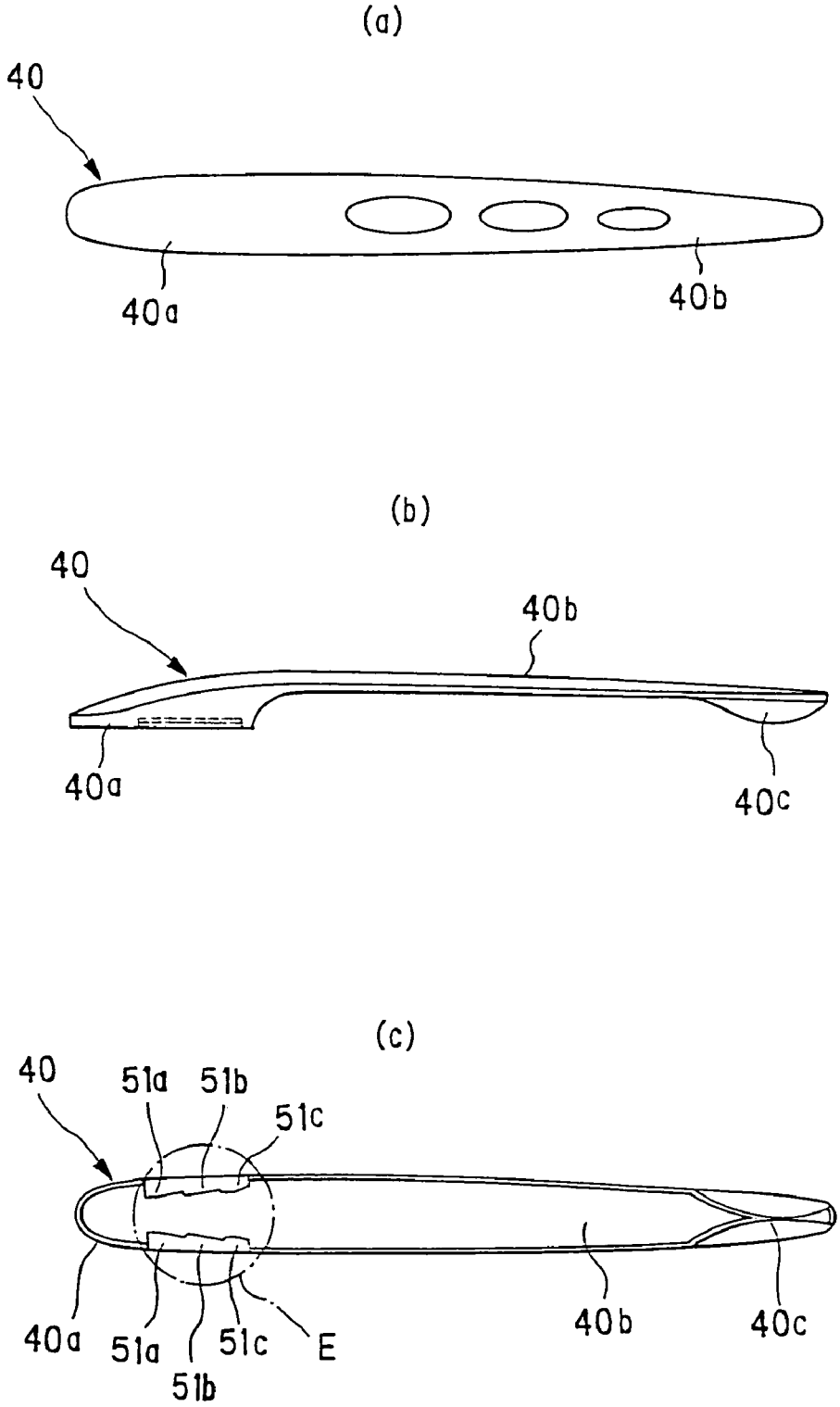
FIG. 10(*a*) is a plan view of a clip, (*b*) a side view thereof, (*c*) a bottom view thereof.

Stopper 47 is a stopper for positioning the clip 40 to be assembled to engaging portion 44, and has a horizontally U-shaped configuration having such a length as to abut the inner wall surface of the front end part of a hooking portion (hook) 40*a* (FIGS. 10(*a*) to (*c*)) of clip 40 to be engaged with the engaging portion 44. This stopper is projectively formed on attachment surface 41*b* on the front end side of guide elements 45, 45 (on the projection 41*a* side).

A depressed portion 48 is a depressed portion formed around engaging portion 44, and is formed in the necessary area enclosing attachment surface 41*a*.

Inner cap 49, as shown in FIGS. 5 and 6, is comprised of a main body 49*a* in the form of an approximate cylinder having an outside diameter that leaves a marginal space with the inner peripheral wall surface in hollow a side crown 37 and a plurality of ribs 49*b* . . . , which are arranged equi-angularly apart on the outer peripheral surface near the rear edge of main body 49*a* and define an outside diameter that abuts the inner peripheral wall surface of the cap sleeve 38. Thereby, inner cap 49 is constructed so as to be able to slide inside crown 7 along the axis O.

The interior of main body 49*a* is sectioned into a spring holding hollow 49*d* and a writing point capping hollow 49*e* by a partition wall 49*c*. Spring 50 fitted to the supporter 43 is accommodated in spring holding hollow 49*d* located on the front end side while the point assembly 34 is fitted into and held by writing point capping hollow 49*e* on the rear end side.

As shown in FIGS. 10(*a*) to (*c*), clip 40 is made of metal and configured so that hooking portion 40*a* for engagement with engaging portion 44 of cap body 39 is formed at the front end while an elongate gripping portion 40*b* is extended from the hooking portion 40*a* toward the rear end side. The detailed configuration is as follows.

Figure 11:
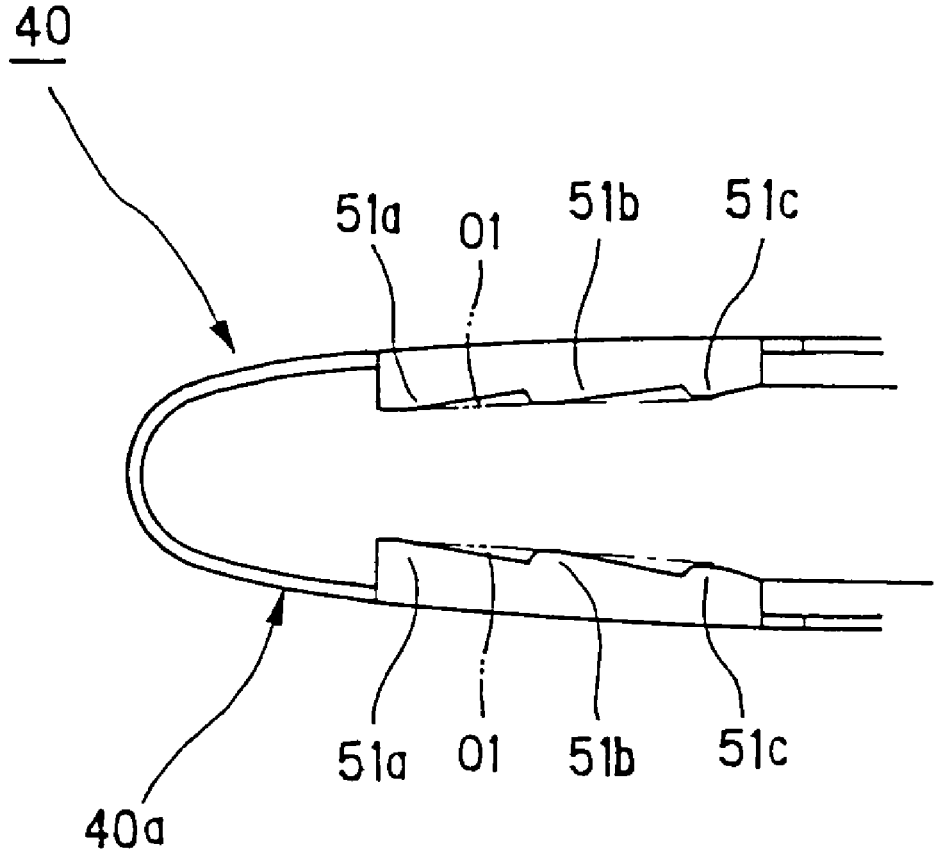
FIG. 11 is an enlarged view showing a portion encircled by E in FIG. 10.

As shown in FIGS. 9 and 11, hooking portion 40*a* is of a volume so as to cover the positioning stopper 47 and engaging portion 44 together, and has a pair of serration of three engaging teeth 51*a*–51*c*, 51*a*–51*c* opposing each other, arranged along the opposing edges of the bottom flanges of the horizontally U-shaped configuration. These engaging teeth 51*a*–51*c* and 51*a*–51*c* are arranged in such a relationship that imaginary lines O1 and O1 (FIG. 11) connecting the serrated tips intersect at a point on the upstream side with respect to the direction β of insertion (FIG. 6). In other words, engaging teeth 51*a*–51*c* and 51*a*–51*c* are arranged in a horizontally tapered manner or in a manner that the spacing between the opposing serrated tips gradually becomes wider from the upstream side to the downstream side with respect to the direction of insertion β.

As shown in FIG. 10, gripping portion 40*b* is formed so as to have bottom opening C-shaped cross-sections which gradually become narrower from the upstream side to the downstream with respect to the direction of insertion β. Further, a gripping bead 40*c* is projectively formed downwards at the rear end so as to be flush with the bottom most face of the hooking portion 40*a*.

Next, the assembly work of the above-described writing instrument cap A will be described.

To begin with, as shown in FIG. 9(*a*), engaging teeth 51*a*–51*c* and 51*a*–51*c* constituting hooking portion 40*a* of clip 40 are set over the top surface of guide elements 45, 45 of engaging portion 44, at a temporal tacking position P1 where the inner wall surface on the front end of clip 40 is located a stroke distance S away from positioning stopper 47, and the clip 40 is pressed down.

Temporal tacking of clip 40 to crown 37 from the radial direction γ (FIGS. 7(*a*) to (*c*)) is effective in implementing assembly by automation since gripping bead 40*c* and others can be kept out of the way.

The pressing force applied in the radial direction γ elastically deforms guide elements 45, 45 so that they come closer to each other, and engaging teeth 51*a*–51*c*, 51*a*–51*c* move down below teeth engaging pieces 45*b*, 45*b* and become engaged with the outer side surfaces of upright legs 45*a*, 45*a*, then guide elements 45, 45 revert back to the upright state before elastic deformation. Thereby, clip 40 is temporarily tacked to crown 37 or cap body 39.

Next, as the temporarily tacked clip 40 is pushed from the upstream side to the downstream side with respect to the insertion direction β of the axial direction (FIGS. 9(*a*) and (*b*)) along guide elements 45, 45, the clip moves from the upstream end to the downstream end with respect to the direction of insertion β into guide elements 45, 45 with engagement between engaging teeth 51*a*–51*c*, 51*a*–51*c* and guide elements 45, 45 gradually increased in strength. Finally, the inner wall surface at the front end of hooking portion 40*a* abuts positioning stopper 47, and is positioned at the predetermined engagement position P2, as shown in FIG. 9(*b*).

At the engagement position P2, as shown in FIG. 9(*b*), engaging teeth 51*a*–51*c*, 51*a*–51*c* are engaged with the shallow serrated projections P formed on the flanks of upright legs 45*a*, so as to prohibit clip 40 from dislodging in the direction toward the temporal tacking position P1.

If only engaging teeth 51*a*–51*c*, 51*a*–51*c* without projections P for upright legs 45*a* can prevent movement of clip 40 toward the temporal tacking position P1, it is not necessary to provide the projections. If formed, one or more projections P will be able to prevent clip 40 from moving toward temporal tacking position P1.

According to the writing instrument cap of the present embodiment, assembly of clip 40 to cap body 39 can be done by implementing the action of pressing hooking portion 40*a* of clip 40 to guide elements 45, 45, and the action of sliding the clip 40 along the guide elements 45, 45, in a time-sequential manner.

The direction of attachment of clip 40 to engaging portion 44 is not limited to the insertion direction β with respect to the axial direction, but the attachment can be made in any other direction as long as the clip is set into the engagement position P2. For example, it is possible to provide a configuration in which clip 40 can be positioned to engagement position P2 with engagement between engaging teeth 51*a*–51*c*, 51*a*–51*c* and guide elements 45, 45 gradually increased in strength as clip 40 is pushed in a direction angled with respect to the insertion direction β of the axial direction.

It should be noted that this invention is not limited to the present embodiment, but many variations are possible within the scope of the invention.

The above description has been made taking an example in which both engaging teeth 51*a*–51*c* and guide elements 45 are formed in horizontally tapered geometry, but it will work if only one, either the engaging teeth or the guide elements may be formed in a horizontally tapered configuration.

The above description has been made taking an example where a plurality of engaging teeth 51*a*–51*c* are formed, but it will work if, at least, one engaging tooth may be formed.

In the above case, teeth engaging pieces 45*b* are projectively formed outwards in an approximately tapered geometry on the tops of upright legs 45*a* in engaging portion 44 of cap body 39 while hooking portion 40*a* of clip 40 is formed with engaging teeth 51*a*–51*c* to be squeezed and fixed to teeth engaging pieces 45*b*. However, the relationship between the shape of teeth engaging pieces 45*b* and that of engaging teeth 51*a*–51*c* may be inverted.

That is, the same effect as above can be obtained by forming engaging teeth 51*a*–51*c* in formed teeth engaging pieces 45*b* and forming hooking portion 40*a* in a tapered configuration.

In order to obtain soft fit feeling and in order to improve fit durability, the cap sleeve 38 may employ a material which is low in rigidity or low in heat resistance, such as PP(polypropylene), PE(polyethylene), CO-PET(which consists of PET as a main component and other resins (e.g., poly-cyclohexanedimethanol(PCT))), a substance including rubber components, or the like.

Though crown 37 is often added for ornamental purposes, in the present embodiment, use of a synthetic resin presenting a higher rigidity or heat resistance than that of cap sleeve 38, such as PC(polycarbonate), ABS, PET(polyethylene), PC/PET(polymer alloy of polycarbonate and polyethylene terephthalate), PC/ABS((polymer alloy of polycarbonate and ABS) and the like, makes it possible to improve the attachment strength and anti-fall strength of clip 40 and is markedly effective for snap-fit performance with respect to the radial direction γ and for fixture by pressing in the direction of insertion β.

The above description has been made taking an example in which engaging portion 44 of cap body 39 is adapted to be elastically deformed, but single-touch fit may be realized by elastic deformation of hooking portion 40*a* of clip 40. Further, single-touch fit may be realized by elastic deformation of both engaging portion 44 of cap body 39 and hooking portion 40*a* of clip 40.

Though engaging portion 44 is formed of a pair of guide elements 45, 45, it may be formed of a single guide element and may be formed with no vent hole 46 (space). That is, engaging portion 44 can be constituted of one or two or more top surfaces as long as it is composed of such inclined top surfaces that the point of intersection X between their tangent lines TL is located within the space for attachment of clip 40.

It should also be noted that provision of a space such as a vent hole 46 for engaging portion 44 facilitates elastic deformation of engaging portion 44 and provision of vent hole 46 assures ventilation through the cap body, whereby it is possible to provide a more effective cap configuration.

As has been described heretofore, according to the writing instruments defined in the first to fifth aspects of the present invention, since the front barrel and the ink tank are formed in one-piece or in an integrated manner as a refill, the ink tank can be constructed by making the optimal use of the space inside the rear barrel so as to increase the ink capacity. Further, this arrangement is effective in providing a point assembly configuration without rattling and yet providing a stylish, user-friendly writing instrument.

According to the writing instruments defined in the sixth to tenth aspects of the present invention, since the cap is formed with a first projected portion for holding the rear part of the writing instrument body and a second projected portion for preventing excess insertion into the cap interior, the fit of the cap by the fitting portion of the cap and the writing instrument body can be formed with a minimum contact and gripping strength without complicating the writing instrument body. Thus, this arrangement produces satisfactory results in fitting the cap with a simple configuration without spoiling the exterior of the writing instrument body as well as degrading the print formed thereon.

According to the writing instruments defined in the eleventh to nineteenth aspects of the present invention, since engagement of the clip to the cap body can be implemented by sliding the clip to the engagement position from the temporal tacking position where the hooking portion of the clip is temporarily tacked to the engaging portion of the cap body, this arrangement enables easy assembly of the cap body and the clip no matter what the cross-section of the clip is, as well as enabling easy automation.

In addition to the above effect common to the inventions of the eleventh to nineteenth aspects, the following effects can be obtained from the inventions described in individual aspects.

According to the writing instrument defined in the twelfth aspect of the present invention, since only the action of pressing down the hooking portion in the radial direction of the cap body against the engaging portion forms temporal tacking to the temporal tacking position, by virtue of elastic deformation of the engaging portion and/or the hooking portion, temporal tacking can be made easily.

Further, only the action of sliding the clip from the temporal tacking position to the engagement position makes it possible to achieve engagement between the cap body and the clip.

According to the writing instrument defined in the thirteenth aspect of the present invention, the engaging portion of the cap body is formed with teeth engaging pieces which are projectively formed outwards from the top edges of the upright legs while the hooking portion of the clip is formed with engaging teeth which are squeezed into and fixed to the upright legs. Since only one of the engaging portion and hooking portion is formed in a tapered configuration or in a stepped configuration, it is possible to achieve tight engagement between the clip and the cap body.

According to the writing instrument defined in the fourteenth aspect of the present invention, since, in the engaging portion of the cap body, at least part of the top surfaces of the teeth engaging pieces are formed with inclined surfaces that produce a centering effect, this provides easiness in centering.

According to the writing instrument defined in the fifteenth aspect of the present invention, since the positioning stopper for positioning the engagement position of the clip to the cap body is formed, it is possible to position the engagement position of the clip in an exact manner.

According to the writing instrument defined in the seventeenth aspect of the present invention, since the cap body is comprised of a crown having the engaging portion projected from the outer peripheral surface thereof and a cap sleeve fitted to the writing instrument body, and the crown is formed with a material presenting higher rigidity and heat resistance than the cap sleeve, it is possible to improve assembly performance, attachment strength and snap-fit performance.

INDUSTRIAL APPLICABILITY

The present invention is suitable for a writing instrument which is free from rattling at the writing point and can secure a large ink capacity without spoiling the external appearance and a writing instrument cap which can be fitted without degrading the print on the writing instrument body as well as a writing instrument cap which is comprised of a cap body and a clip portion as separate parts and can be completed by joining the cap body and the clip portion.

What is claimed is:

1. A writing instrument comprising: a writing instrument body having a refill with a front barrel, and a rear barrel to which the refill is fitted; and a cap as a separate part from the writing instrument body, wherein the refill is comprised of the front barrel and an ink tank, the ink tank is accommodated in the rear barrel and removably fitted to the rear barrel, when the cap is fitted to the writing instrument body, the cap is positioned and fastened to the writing instrument body by abutting an opening end of the cap to a refill attachment side end of the rear barrel, the cap includes: an inner cap disposed inside the cap so as to be movable in the axial direction of the cap by virtue of an elastic element; and a stroke limiter projectively formed from the front end side of the cap interior so as to oppose the inner cap to limit the movement of the inner cap, and the inner cap has a cylindrical front part in which a stopper portion is projectively formed, whereby the movement of the inner cap is restrained by the abutment of the stopper portion and stroke limiter.

2. The writing instrument according to claim 1, wherein the ink tank stores free ink therein, at least part of the ink tank is formed with a transparent or translucent resin material which makes the ink therein visible, and at least part of the rear barrel is formed with a transparent or translucent resin material which makes the ink tank therein visible.

3. The writing instrument according to claim 1, wherein an opening or a transparent portion which makes the ink tank held in the rear barrel visible is formed at least part of the outer periphery of the rear barrel.

4. The writing instrument according to claim 1, wherein the inner cap is formed of an opaque resin.

5. A writing instrument cap provided separately from a writing instrument body, wherein the cap has an approximately cylindrical hollow therein which accommodates a point assembly of the writing instrument and has an inside diameter greater than the outside diameter of the rear part of the writing instrument body, the hollow has a first projected portion formed inwards and circumferentially on an inner wall and a second projected protion projected along a longitudinal axis of the cap at a position closer to a crown portion of the cap than the first projected portion, and when the cap is fitted to a rear part of the writing instrument body, the first projected portion holds an outer periphery of the rear part of the writing instrument body and the second projected portion limits the insertion of a rear end of the rear part of the writing instrument body into the cap interior.

6. The writing instrument cap according to claim 5, wherein the cap has an inner cap inside the hollow for sealing the vicinity of the point assembly of the writing instrument body, the inner cap is formed so as to be movable inside the hollow along the direction of insertion of the point assembly, by virtue of an elastic element disposed on the front end side in the hollow, and the second projected portion is projectively formed opposed the inner cap.

7. The writing instrument cap according to claim 6, wherein the inner cap has a cylindrical front part, a stopper portion opposing the second projected portion is projectively formed inside the cylindrical front part of the inner cap, and the movement of the inner cap is restrained by an abutment of the stopper portion and the second projected portion.

8. The writing instrument cap according to claim 6, wherein a gripping force of the rear part of the writing instrument body by the first projected portion is set to be greater than a repulsive force of the elastic element.

9. The writing instrument cap according to claim 6, wherein the elastic element is a coil spring.

10. A writing instrument cap provided separately from a writing instrument body, wherein the cap has an approximately cylindrical hollow therein which accommodates a point assembly of the writing instrument and has an inside diameter greater than the outside diameter of the rear part of the writing instrument body, the hollow has a first projected portion formed inwards and circumferentially on an inner wall and a second projected portion projected in a direction of an axis of the cap at a position closer to the cap front than the first projected portion, when the cap is fitted to a rear part of the writing instrument body, the first projected portion holds an outer periphery of the rear part of the writing instrument body and the second projected portion limits the insertion of a rear end of the rear part of the writing instrument body into the cap interior, the cap has an inner cap inside the hollow for sealing the vicinity of the point assembly of the writing instrument body, the inner cap is formed so as to be movable inside the hollow along the direction of insertion of the point assembly, by virtue of an elastic element disposed on the front end side in the hollow, and the second projected portion is projectively formed opposing the inner cap.

11. The writing instrument cap according to claim 10, wherein the inner cap has a cylindrical front part, a stopper portion opposing the second projected portion is projectively formed inside the cylindrical front part of the inner cap, and the movement of the inner cap is restrained by an abutment of the stopper portion and the second projected portion.

12. The writing instrument cap according to claim 10, wherein a gripping force of the rear part of the writing instrument body by the first projected portion is set to be greater than a repulsive force of the elastic element.

13. The writing instrument cap according to claim 10, wherein the elastic element is a coil spring.

* * * * *

UNITED STATES PATENT AND TRADEMARK OFFICE

CERTIFICATE OF CORRECTION

PATENT NO. : 6,966,718 B2
DATED : November 22, 2005
INVENTOR(S) : Kazuhiko Furukawa et al.

It is certified that error appears in the above-identified patent and that said Letters Patent is hereby corrected as shown below:

Column 20,
Line 61, change "protion" to -- portion --.

Signed and Sealed this

Fourth Day of April, 2006

JON W. DUDAS
*Director of the United States Patent and Trademark Office*